US009212563B2

(12) United States Patent
Farineau et al.

(10) Patent No.: US 9,212,563 B2
(45) Date of Patent: Dec. 15, 2015

(54) TURBINE ROTOR AND BLADE ASSEMBLY WITH MULTI-PIECE LOCKING BLADE

(75) Inventors: Thomas Joseph Farineau, Schoharie, NY (US); Edward Arthur Dewhurst, Niskayuna, NY (US); Timothy Scott McMurray, Rotterdam Junction, NY (US); Manuel Fernandez, Mazowieckie (PL); John Thomas Basirico, Albany, NY (US)

(73) Assignee: General Electric Company, Schenectady, NY (US)

( * ) Notice: Subject to any disclaimer, the term of this patent is extended or adjusted under 35 U.S.C. 154(b) by 550 days.

(21) Appl. No.: 13/489,502

(22) Filed: Jun. 6, 2012

(65) Prior Publication Data

US 2013/0330204 A1 Dec. 12, 2013

(51) Int. Cl.
*F01D 5/32* (2006.01)
*F01D 5/30* (2006.01)

(52) U.S. Cl.
CPC ..... *F01D 5/3038* (2013.01); *F01D 5/32* (2013.01)

(58) Field of Classification Search
CPC ..... F01D 5/32; F01D 5/3038
USPC ..... 416/215, 216, 217, 220 R, 193 A
See application file for complete search history.

(56) References Cited

U.S. PATENT DOCUMENTS

| | | | | |
|---|---|---|---|---|
| 1,687,891 | A * | 10/1928 | Ray | 416/216 |
| 1,705,585 | A * | 3/1929 | Ray | 416/216 |
| 2,315,631 | A * | 4/1943 | Lloyd et al. | 416/216 |
| 2,918,255 | A * | 12/1959 | McGinnis | 416/216 |
| 6,419,447 | B1 | 7/2002 | Watanabe et al. | |
| 7,901,187 | B2 | 3/2011 | Barber | |
| 2006/0245927 | A1 | 11/2006 | Yehle et al. | |
| 2007/0048130 | A1 | 3/2007 | Sullivan et al. | |
| 2007/0248464 | A1 | 10/2007 | Caruso et al. | |
| 2009/0047128 | A1 | 2/2009 | Bracken et al. | |
| 2010/0278652 | A1 | 11/2010 | Vitrone et al. | |
| 2011/0154631 | A1 | 6/2011 | DeMania et al. | |
| 2011/0158814 | A1 | 6/2011 | Metri et al. | |
| 2011/0158815 | A1 | 6/2011 | Mandali et al. | |
| 2011/0163505 | A1 | 7/2011 | Bhagavatheeswaran et al. | |
| 2012/0034086 | A1 | 2/2012 | Mishrikotkar et al. | |

FOREIGN PATENT DOCUMENTS

GB 704882 A * 3/1954

* cited by examiner

*Primary Examiner* — Igor Kershteyn
*Assistant Examiner* — Jesse Prager
(74) *Attorney, Agent, or Firm* — Sutherland Asbill & Brennan LLP

(57) ABSTRACT

The present application provides a turbine rotor and blade assembly for a steam turbine. The turbine rotor and blade assembly may include a rotor, a number of buckets positioned about the rotor, and a locking blade positioned about the rotor. The locking blade may include a multi-piece configuration.

14 Claims, 2 Drawing Sheets

TURBINE ROTOR AND BLADE ASSEMBLY WITH MULTI-PIECE LOCKING BLADE

TECHNICAL FIELD

The present application and the resultant patent relate generally to turbo-machinery and more particularly relate to a turbine rotor and blade assembly for use with a steam turbine having a multi-piece locking blade for reduced stress concentrations therein.

BACKGROUND OF THE INVENTION

Steam turbine airfoils or buckets generally are positioned about a rotor at regular intervals in a bucket assembly. The bucket assembly may be created by inserting the buckets one at a time tangentially into an opening on the rotor and then sliding the buckets circumferentially about the rotor. The buckets may be attached to the rotor by complementary male and female dovetails and other configurations. In order to close the bucket assembly, however, the last bucket must be restrained by a feature other than a dovetail. This last bucket, generally called the locking blade or the closure bucket, may be affixed to the rotor via one or more blade retention screws and the like tapped or screwed into the rotor. Other types of connection means and other types of bucket assemblies also may be used.

Large centrifugal loads may be placed on the buckets and the rotor during operation. Such centrifugal loads and coincident thermally induced loads associated with loading transients may induce stresses in the dovetails and adjacent areas that attach the buckets to the rotor. These stresses may be of sufficient magnitude to impact adversely rotor cycle fatigue life. Of particular concern may be rotor stress concentrations associated with blade retention screws that may be tapped or otherwise inserted directly into the rotor.

There is thus a desire for an improved turbine rotor and blade assembly for a steam turbine and the like. Preferably such an improved turbine rotor and blade assembly may reduce stress concentrations therein for an improved overall rotor fatigue life.

SUMMARY OF THE INVENTION

The present application and the resultant patent thus provide herein a turbine rotor and blade assembly for a steam turbine. The turbine rotor and blade assembly may include a rotor, a number of buckets positioned about the rotor, and a locking blade positioned about the rotor. The locking blade may include a multi-piece configuration.

The present application and the resultant patent further provide a multi-piece locking blade for use with a rotor. The multi-piece locking blade may include a base, a first side hook on a first side of the base, and a second side hook on a second side of the base.

The present application and the resultant patent further provide a steam turbine. The steam turbine may include a rotor, a number of buckets positioned about the rotor, and a multi-piece locking blade positioned about the rotor. The multi-piece locking blade may include a base, a first side hook, and a second side hook.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
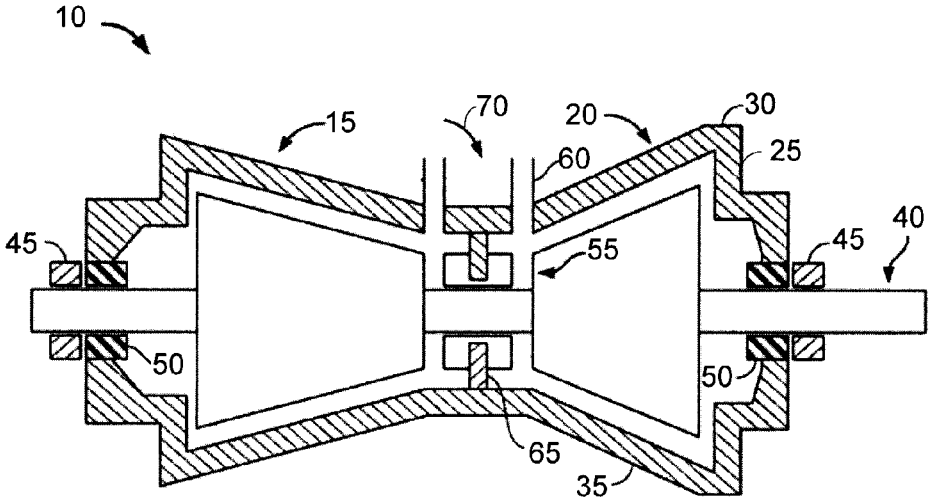
FIG. 1 is a schematic diagram of an example of a steam turbine with a number of sections.

Referring now to the drawings, in which like numerals refer to like elements throughout the several views, FIG. 1 is a schematic diagram of an example of a steam turbine 10 as may be used herein. The steam turbine 10 may include a first section 15 and a second section 20. The sections 15, 20 may be high pressure sections, intermediate pressure sections, and/or low pressure sections. Each of the sections 15, 20 may have a number of stages therein. An outer shell or casing 25 may be divided axially into upper and lower half sections 30, 35, respectively. A rotor shaft 40 may extend through the casing 25 and may be supported by a number of journal bearings 45. A number of seals 50 also may surround the rotor shaft 40 about the ends and elsewhere. A central section 55 may include one or more steam inlets 60. A flow splitter 65 may extend between the sections 15, 20.

In use, a flow of steam 70 passes through the steam inlets 60 and into the sections 15, 20 such that mechanical work may be extracted from the steam by the stages therein so as to rotate the rotor shaft 40. The flow of steam 70 then may exit the sections 15, 20 for further processing and the like. The steam turbine 10 described herein is for the purpose of example only. Steam turbines and/or other types of turbo-machinery in many other configurations and with many other or different components also may be used herein.

Figure 2:
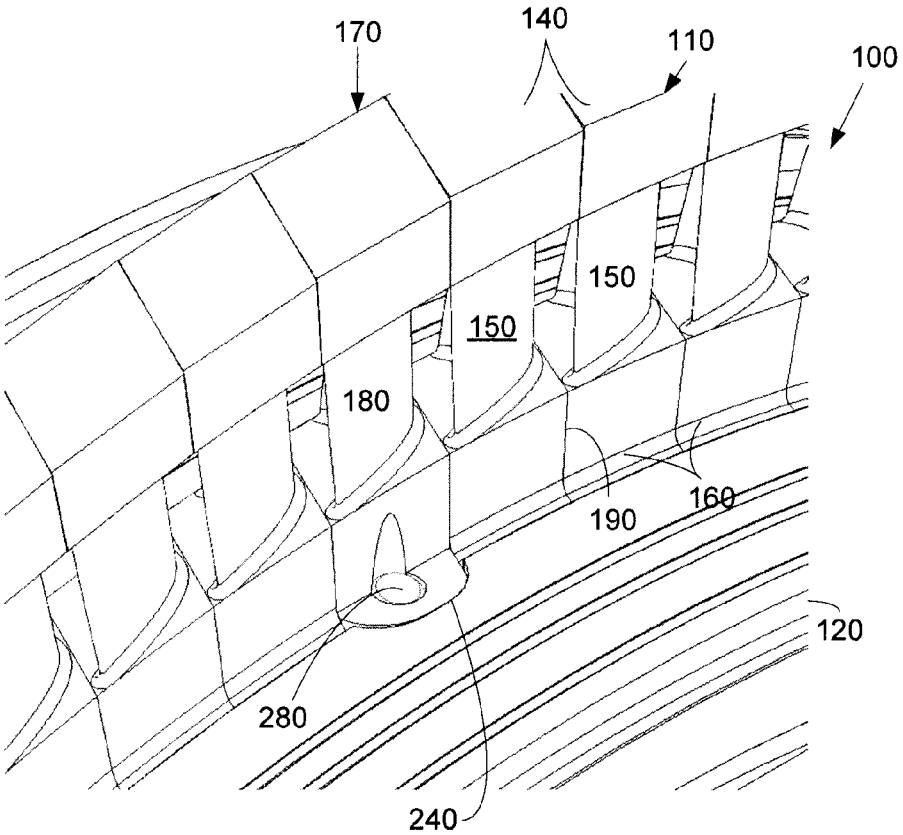
FIG. 2 is a partial perspective view of a turbine rotor and blade assembly as may be described herein.

FIG. 2 shows a portion of a steam turbine 100 as may be described herein. Specifically, the steam turbine 100 may include a turbine rotor and blade assembly 110. The turbine rotor and blade assembly 110 includes a turbine rotor 120. The turbine rotor 120 includes a dovetail slot 130 formed therein. A number of buckets 140 may be mounted on the rotor 120 via tangential entry and the like. Each of the buckets 140 may include a blade 150 and a dovetail 160. The dovetail 160 may be configured to mate with the conforming dovetail slot 130 (or vice versa) of the rotor 120. The rotor 120 and the buckets 140 may have any size, shape, or configuration. Other components and other configurations may be used herein.

Figure 3:
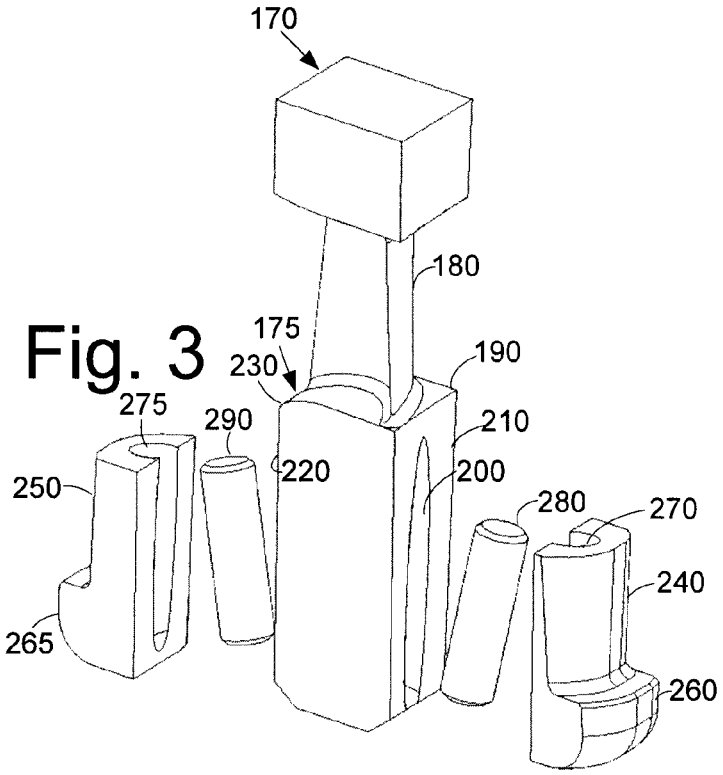
FIG. 3 is an exploded view of a locking blade for use with the turbine rotor and blade assembly of FIG. 2.

As is shown in FIG. 2 and FIG. 3, the turbine rotor and blade assembly 100 also may include a locking blade 170. As described above, the locking blade 170 may lack the dovetail 160. Rather, the locking blade 170 may have a multi-piece configuration 175. Specifically, the locking blade 170 may include a blade 180 extending from a base 190. The size, shape, and configuration of the base 190 may vary. The base 190 may have a first side base screw thread 200 on a first side 210 and a second side base screw thread 220 on a second side 230. The base 190 may be surrounded, in whole or in part, by a pair of hooks with a first side hook 240 on the first side 210 of the base 190 and a second side hook 250 on the second side 230 of the base 190. Each hook 240, 250 may have an outwardly extending flange, a first flange 260 and a second flange 265. The size, shape, and configuration of the hooks 240, 250, and the flanges 260, 265 may vary. Each of the hooks 240, 250 also may include a hook screw thread thereon, a first hook screw thread 270 and a second hook screw thread 275. A pair of screws such as a first side screw 280 and a second side screw 290 may be used to attach the hooks 240, 250 to the base 190. Other components and other configurations may be used herein.

Figure 4:
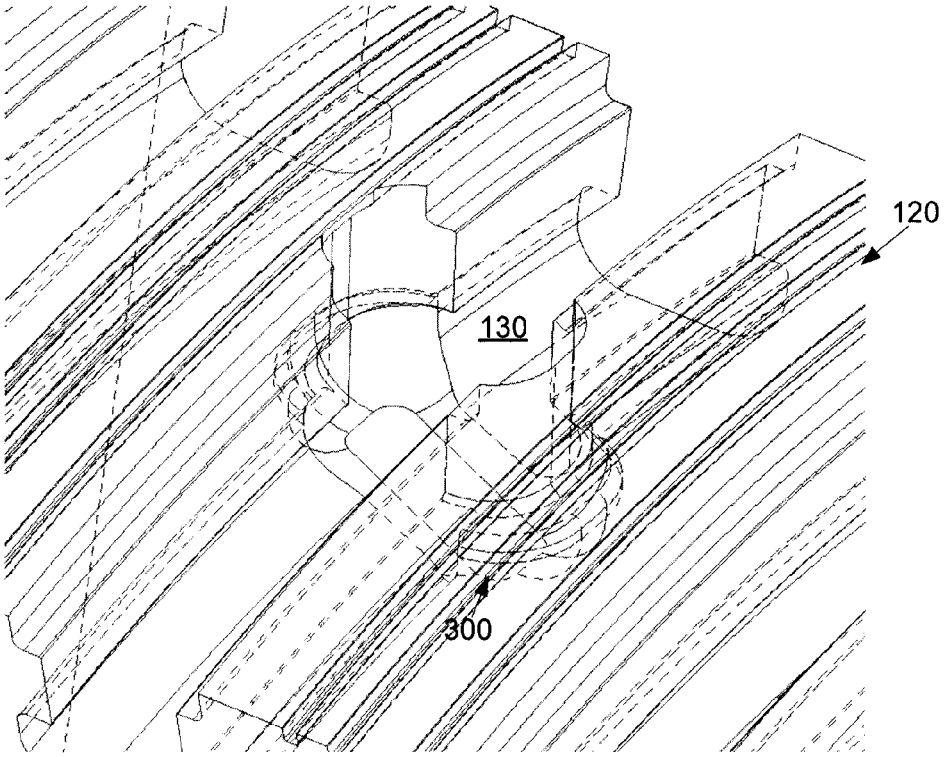
FIG. 4 is a partial transparent view of a rotor for use with the turbine rotor and blade assembly of FIG. 2.

As is shown in FIG. 4, the rotor and blade assembly 100 also may include a locking blade groove 300 positioned within the dovetail slot 130 of the rotor 120. The locking blade groove 300 may be sized to accommodate the base 190 and the hooks 240, 250 of the locking blade 170. Specifically, the locking blade groove 300 may be sized to accommodate the flanges 260, 265 on both of the hooks 240, 250. Other components and other configurations may be used herein.

In use, the buckets 140 of the rotor and blade assembly 110 may be positioned about the rotor 120 within the dovetail slot 130 as is described above. When all of the buckets 140 have been positioned thereon, the locking blade 170 may be inserted. Specifically, the hooks 240, 250 may be inserted within the locking blade groove 300 in the rotor 120. The base 190 then may be inserted between the hooks 240, 250. The base 190 then may be secured by inserting the side screws 280, 290 between the base screw threads 200, 220 and the hook screw threads 270. The rotor and blade assembly 100 thus may be secure. The rotor and blade assembly 110 also may be disassembled in reverse order.

The locking blade 170 with the multi-piece configuration 175 thus may improve the overall fatigue life of the turbine rotor blade assembly 110. Specifically, the use of the multi-piece configuration 175 may avoid inherent rotor stress concentrations that may be caused by the small radius of a tapped hole when using blade retention screws and the like. Rather, the multi-piece configuration 175 uses the hooks 240, 250 within the locking blade groove 300 of the rotor 120 without requiring the use of screws tapped or otherwise inserted into the rotor 120. The multi-piece configuration 175 thus may improve the fatigue life of the rotor 120 and related components for an extended component lifetime.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine rotor and blade assembly for a steam turbine, comprising:

a rotor;

a plurality of buckets positioned about the rotor; and a locking blade positioned about the rotor;

the locking blade comprising a multi-piece configuration, wherein the locking blade comprises:

a base with a first substantially planar side and a second substantially planar side, the first planar side comprising a first side base partial screw thread extending into the first planar side and the second planar side comprising a second side base partial screw thread extending into the second planar side, wherein the first side base partial screw thread and the second side base partial screw thread extend to a base bottom of the respective first planar side and the second planar side;

a first side hook with a first planar mating surface configured to mate with the first planar side of the base, the first side hook comprising:

a first side hook partial screw thread extending into the first planar mating surface that corresponds to the first side base partial screw thread to form a first complete screw thread in between the first planar side of the base and the first planar mating surface of the first side hook, wherein the first side hook partial screw thread does not extend to a first side hook bottom;

a first hook portion; and a second hook portion that extends further axially into the rotor than the first hook portion; and a second side hook with a second planar mating surface configured to mate with the second planar side of the base, the second side hook comprising:

a second side hook partial screw thread extending into the second planar mating surface that corresponds to the second side base partial screw thread to form a second complete screw thread in between the second planar side of the base and the second planar mating surface of the second side hook, wherein the second side hook partial screw thread does not extend to a second side hook bottom;

a third hook portion; and a fourth hook portion that extends further axially into the rotor than the third hook portion;

wherein the first side hook and the second side hook have curved outer surfaces configured to mate with curved inner surfaces of the rotor.

2. The turbine rotor and blade assembly of claim 1, wherein the locking blade comprises a blade extending from the base.

3. The turbine rotor and blade assembly of claim 1, wherein the locking blade comprises a first side screw between the base and the first side hook and a second side screw between the base and the second side hook.

4. The turbine rotor and blade assembly of claim 1, wherein the first side hook comprises a first flange and the second side hook comprises a second flange.

5. The turbine rotor and blade assembly of claim 4, wherein the rotor comprises a locking blade groove sized to accommodate the first flange and the second flange of the base of the locking blade.

6. The turbine rotor and blade assembly of claim 1, wherein the rotor comprises a dovetail slot and wherein the plurality of buckets is positioned therein.

7. The turbine rotor and blade assembly of claim 6, wherein each of the plurality of buckets comprises a dovetail for mating with the dovetail slot.

8. A multi-piece locking blade for use with a rotor, comprising:

a base comprising a first side base screw thread on a first planar side and a second side base screw thread on a second planar side, the first side base screw thread extending to a bottom of the first planar side of the base and the second side base screw thread extending to the bottom of the second planar side of the base;

a first side hook with a first planar mating surface configured to mate with the first planar side of the base, the first side hook comprising:

a first side hook partial screw thread extending into the first planar mating surface that corresponds to the first side base partial screw thread to form a first complete screw thread in between the first planar side of the base and the first planar mating surface of the first side hook, wherein the first side hook partial screw thread does not extend to a first side hook bottom;

a first hook portion; and a second hook portion that extends further axially into the rotor than the first hook portion; and a second side hook with a second planar mating surface configured to mate with the second planar side of the base, the second side hook comprising:

a second side hook partial screw thread extending into the second planar mating surface that corresponds to the second side base partial screw thread to form a second complete screw thread in between the second planar side of the base and the second planar mating surface of the second side hook, wherein the second side hook partial screw thread does not extend to a second side hook bottom;

a third hook portion; and a fourth hook portion that extends further axially into the rotor than the third hook portion;

wherein the first side hook and the second side hook have curved outer surfaces configured to mate with curved inner surfaces of the rotor.

9. The multi-piece locking blade of claim 8, wherein the locking blade comprises a first side screw between the base and the first side hook and a second side screw between the base and the second side hook.

10. The multi-piece locking blade of claim 8, wherein the first side hook comprises a first flange and the second side hook comprises a second flange.

11. The multi-piece locking blade of claim 8, wherein the locking blade comprises a blade extending from the base.

12. A steam turbine, comprising:

a rotor;

a plurality of buckets positioned about the rotor; and a multi-piece locking blade positioned about the rotor;

the multi-piece locking blade comprising a base, a first side hook, and a second side hook, wherein the base comprises a first side base screw thread on a first side and a second side base screw thread on a second side, the first side base screw thread extending to a bottom of the base and the second side base screw thread extending to the bottom of the base; and wherein:

the first side hook has a first planar mating surface configured to mate with the first planar side of the base, the first side hook comprising:

a first side hook partial screw thread extending into the first planar mating surface that corresponds to the first side base partial screw thread to form a first complete screw thread in between the first planar side of the base and the first planar mating surface of the first side hook, wherein the first side hook partial screw thread does not extend to a first side hook bottom;

a first hook portion; and a second hook portion that extends further axially into the rotor than the first hook portion; and the second side hook has a second planar mating surface configured to mate with the second planar side of the base, the second side hook comprising:

a second side hook partial screw thread extending into the second planar mating surface that corresponds to the second side base partial screw thread to form a second complete screw thread in between the second planar side of the base and the second planar mating surface of the second side hook, wherein the second side hook partial screw thread does not extend to a second side hook bottom;

a third hook portion; and a fourth hook portion that extends further axially into the rotor than the third hook portion; and the first side hook and the second side hook have curved outer surfaces configured to mate with curved inner surfaces of the rotor.

13. The steam turbine of claim 12, wherein the multi-piece locking blade comprises a first side screw between the base and the first side hook and a second side screw between the base and the second side hook.

14. The steam turbine of claim 12, wherein the first side hook comprises a first flange and the second side hook comprises a second flange and wherein the first flange and the second flange are sized to accommodate a locking blade groove in the rotor.

* * * * *